US012677916B2

(12) United States Patent
Kong

(10) Patent No.: US 12,677,916 B2
(45) Date of Patent: Jul. 14, 2026

(54) ELECTRIC UMBRELLA

(71) Applicant: Zhejiang Dingsheng Outdoor Living Products Co., Ltd., Taizhou City (CN)

(72) Inventor: Bingcan Kong, Taizhou City (CN)

( * ) Notice: Subject to any disclaimer, the term of this patent is extended or adjusted under 35 U.S.C. 154(b) by 167 days.

(21) Appl. No.: 18/672,525

(22) Filed: May 23, 2024

(65) Prior Publication Data

US 2025/0275612 A1 Sep. 4, 2025

(30) Foreign Application Priority Data

Mar. 4, 2024 (CN) ..... 202410241802.5

(51) Int. Cl.
*A45B 23/00* (2006.01)
*A45B 19/10* (2006.01)
*A45B 25/14* (2006.01)

(52) U.S. Cl.
CPC ..... *A45B 23/00* (2013.01); *A45B 19/10* (2013.01); *A45B 25/143* (2013.01); *A45B 2023/005* (2013.01); *A45B 2023/0068* (2013.01)

(58) Field of Classification Search
CPC ..... A45B 23/00; A45B 2023/0031; A45B 2023/0037; A45B 2023/0081
See application file for complete search history.

(56) References Cited

U.S. PATENT DOCUMENTS 4,586,525 A * 5/1986 Glatz ..... A45B 23/00 135/21
5,116,258 A * 5/1992 Vennik ..... A45B 23/00 135/21
5,785,069 A * 7/1998 Glatz ..... A45B 23/00 135/21
6,923,193 B2 * 8/2005 Chen ..... A45B 23/00 135/21
6,926,019 B2 * 8/2005 Glatz ..... A45B 25/14 135/21
7,334,590 B2 * 2/2008 Chang ..... A45B 23/00 242/396.5
11,122,872 B2 * 9/2021 He ..... A45B 23/00
2005/0016571 A1 * 1/2005 Wu ..... A45B 25/165 135/20.1
2020/0397103 A1 * 12/2020 Glatz ..... A45B 25/14

* cited by examiner

*Primary Examiner* — Noah Chandler Hawk
(74) *Attorney, Agent, or Firm* — Wang Law Firm, Inc.

(57) ABSTRACT

An electric umbrella has a column, a first driving assembly, a slider, an umbrella frame, a second driving assembly, a power source and a control module. The first driving assembly is arranged on the column. The umbrella frame connects to the column and the slider, and the second driving assembly is arranged on the umbrella frame. A power source is charged by solar energy, a control module connects to the first driving assembly, the second driving assembly and the power source, respectively. When the electric umbrella needs to be folded or unfolded and the angle of the electric umbrella needs to be adjusted, a motor operates to drive a rope winding wheel to rotate, and the rope winding wheel rotates to adjust a traction rope, thereby enabling the folding or unfolding of the umbrella and adjustment of the angle of the umbrella frame.

6 Claims, 18 Drawing Sheets

ELECTRIC UMBRELLA

TECHNICAL FIELD OF THE INVENTION

The present invention relates to a field of electric umbrellas, and in particular to a dual-motor-driven electric umbrella powered by solar energy.

BACKGROUND OF THE INVENTION

A traditional umbrella is designed in a manner of manually folding/unfolding and adjusting an angle; folding/unfolding and angle adjustment of the umbrella are relatively laborious, leading to poor user experience.

With the continuous improvement of people's living standards, electric umbrellas have been gradually promoted; an electric driving assembly is used to fold/unfold an umbrella frame (canopy) or adjust the sun-shading angle of the umbrella, so that consumers can use the umbrella conveniently, quickly and lightly.

For example, a Chinese patent CN102258250B (patent No.: CN201110206460.6) discloses a remote-control electric hanging umbrella powered by solar energy and a control method therefor, which are designed to solve the technical problems that folding/unfolding of umbrella frame and inclination angle adjustment of the umbrella frame in the same kind of products are inconvenient. The electric hanging umbrella comprises a handle assembly, an upper umbrella nest, a lower umbrella nest and accessories; The main feature of the electric hanging umbrella is: a handle of the handle assembly has a handle motor, the upper umbrella nest has a solar panel, a battery, a circuit control board and an umbrella nest motor, and the handle motor of the handle assembly is connected to the circuit control board of the upper umbrella nest via an electric wire. The control method therefor is as follows: a remote controller among the accessories or a button arranged on the umbrella controls automatic folding/unfolding of the umbrella frame and inclination angle adjustment of the umbrella frame; the handle assembly is used for allowing manual control of inclination angle adjustment of the umbrella body and controlling the folding/unfolding of the umbrella frame. The above-stated electric umbrella is reasonable and skillful, convenient to assemble and be put into production, novel and practical, and simple and beautiful, and the control method is feasible; the design principle of the above-stated electric umbrella is applicable to the same kind of products for folding/unfolding of umbrella frame and inclination angle adjustment of the umbrella frame.

The disadvantages of the above-stated electric umbrella lie in that: a screw-nut mechanism is used for folding/unfolding of the umbrella frame, and due to limited length of the screw, the inclination angle of umbrella frame (relating to the sun-shading angle of the canopy of the umbrella) between the folded state of the umbrella and the unfolded state of the umbrella only can change in a limited range, and particularly in an umbrella-folded state, the umbrella frame (canopy) cannot be effectively folded, a volume of the umbrella is still relatively large, and a speed is also relatively slow, so that further improvement of the electric umbrella is required.

SUMMARY OF THE INVENTION

It is an object of the present invention to provide a dual-motor-driven electric umbrella, such that automatic folding/unfolding of the umbrella frame (canopy) and inclination angle adjustment of the umbrella frame can be controlled, the operation of folding/unfolding of the umbrella can save time and labor, and when the umbrella is in a folded state, the umbrella frame (canopy) can be effectively folded, and the volume of the umbrella can be greatly reduced, thereby being convenient to use.

For achieving the above object, the electric umbrella comprises a column having a top; a first driving assembly; a slider slidably disposed on the column; an umbrella frame; a second driving assembly; a power source; a control module; and a traction rope having a first end and a second end; wherein, the umbrella frame comprises a first connecting rod having a first end and a second end, a second connecting rod, a plurality of long rods, a plurality of short rods, a long rod nest, a short rod nest, a large support rod and a central pipe connecting to either the long rod nest or the short rod nest; the first end of the first connecting rod rotatably connects to the top of the column and the second end of the first connecting rod rotatably connects to the second connecting rod, the second connecting rod rotatably connects to the long rod nest, the first connecting rod, the slider and the large support rod, respectively; the first driving assembly is disposed on the column to drive the slider movably along the column so as to adjust an inclination angle of the umbrella frame; the second driving assembly is an electric driver which is capable of winding the traction rope for unfolding or folding the umbrella frame, the second driving assembly is disposed on the short rod nest; the first end of the traction rope connects to the second driving assembly and the second end of the traction rope passes through the central pipe and connects to the long rod nest; or, the second driving assembly is an electric driver which is capable of winding the traction rope for unfolding or folding the umbrella frame, the second driving assembly is disposed on the long rod nest; the first end of the traction rope connects to the second driving assembly and the second end of the traction rope passes through the central pipe and connects to the short rod nest.

Preferably, the second driving assembly comprises a second motor having an output and a second driving gears having an input and an output, the output of the second motor connects to the input of the second driving gears, a winding wheel connects to the output of the second driving gears, the traction rope comprises a third traction rope segment, the third traction rope segment is winded on the winding wheel and an end of the third traction rope segment connects to the long rod nest of the umbrella frame.

Or, preferably, the second driving assembly comprises the second motor having an output and the second driving gears having an input and an output, the output of the second motor connects to the input of the second driving gears, a winding wheel connects to the output of the second driving gears, the traction rope comprises a third traction rope segment, the third traction rope segment is winded on the winding wheel and an end of the third traction rope segment connects to the short rod nest of the umbrella frame.

Preferably, the first driving assembly comprises a first motor, a first driving gears, a first output shaft, a second output shaft, a first rope winding wheel, a second rope winding wheel, a first traction rope segment, a second traction rope segment, and a rope-guide pulley; the first motor connects to the first rope winding wheel and the second rope winding wheel through the first driving gears, the first rope winding wheel connects to the slider via the first traction rope, the second rope winding wheel connects to the slider by the second traction rope via the rope-guide pulley, the slider rotatably connects to the second connecting rod.

Preferably, the rope-guide pulley is mounted on a rope-guide pulley frame, the rope-guide pulley frame is movably mounted on a rope-guide pulley frame fixing plate fastened by a connecting pin having a limiting portion at one end of the connecting pin, the rope-guide pulley frame fixing plate is fixed inside the column, a spring is mounted on the connecting pin which is arranged below the rope-guide pulley frame, and is used for automatically tensioning the traction rope.

Preferably, the first driving assembly comprises a first motor, a first driving gears, a transmission screw having a first end and a second end, a nut and a bearing; the first motor connects to the first end of the transmission screw which is longitudinally arranged in the column through the first driving gears, the second end of the transmission screw is mounted inside the column through the bearing, the nut is connected to the slider so that the slider is sleeved on the transmission screw and is capable of moving along the column, the slider rotatably connects to the second connecting rod.

Preferably, the first driving assembly comprises a first motor, a first driving gears, a synchronous belt having a first end and a second end, a synchronous driving pulley wheel, and a synchronous driven pulley wheel; the first motor connects to the synchronous driving pulley wheel through the first driving gears, the synchronous driven pulley wheel is arranged inside a lower portion of the column, the slider is sleeved on a middle portion of the column so that the slider is capable of moving along the column, the first end of the synchronous belt connects to the slider, the second end of the synchronous belt turns around synchronous driving pulley wheel and the synchronous driven pulley wheel and connects to the slider, the synchronous belt is in circle and the slider is as a beginning point and a terminal point, and the slider rotatably connects to the second connecting rod.

Preferably, the synchronous belt driven pulley is arranged on a driven pulley frame, the driven pulley frame is movably mounted on a driven pulley frame fixing plate through the connecting pin having a limiting portion at one end of the connecting pin, the driven pulley frame fixing plate is fixed inside the column, a spring is mounted on the connecting pin which is arranged below the driven pulley frame, and is used for automatically tensioning the synchronous belt.

Preferably, the control module comprises a control main board, and a control panel and/or a wireless control module; the control main board connects to the control main board and/or the wireless control module, and the control main board connects to the first driving assembly and the second driving assembly, so as to control the first driving assembly and the second driving assembly step by step or simultaneously, thereby enabling step-by-step or simultaneous automatic unfolding/folding of the electric umbrella and automatic adjustment of a sun-shading angle of the electric umbrella.

Preferably, the power source comprises a solar photovoltaic panel, a solar module having two ends and an energy storage battery; the solar module is arranged between the solar photovoltaic panel and the energy storage battery, the solar module converts solar energy into electric energy to charge the energy storage battery, the energy storage battery may also be charged by the solar energy, or removed to be charged.

Compared with the prior art, the advantages of the present invention lie in that: the operation of folding/unfolding of the umbrella and angle adjustment of the umbrella frame can be finished without a lot effort of human, and the electric umbrella of the present invention achieves automatic folding/unfolding of the umbrella and angle adjustment of the umbrella frame, thereby saving the labor of users and improving the user experience.

Moreover, the second driving assembly is an electric driver which is capable of winding the traction rope for unfolding or folding the umbrella frame, the second driving assembly is disposed on the short rod nest; the first end of the traction rope connects to the second driving assembly and the second end of the traction rope passes through the central pipe and connects to the long rod nest; or, the second driving assembly is an electric driver which is capable of winding the traction rope for unfolding or folding the umbrella frame, the second driving assembly is disposed on the long rod nest; the first end of the traction rope connects to the second driving assembly and the second end of the traction rope passes through the central pipe and connects to the short rod nest, accordingly, the obvious defects of using a screw-nut transmission mechanism can be overcame; and when in a folded state, the umbrella frame of the present invention can be effectively folded, the volume of the umbrella can be greatly reduced under which the wind resistance received by the folded umbrella can be effectively reduced, the umbrella folding speed is high, no transmission component is exposed, the umbrella is neat and beautiful, and is convenient to use; and the sun-shading angle of the umbrella frame between a folded state and an unfolded state of the umbrella has a greater range of change, thereby making the umbrella be more suitable for sun-shading.

DETAILED DESCRIPTION OF THE INVENTION

Figure 1:
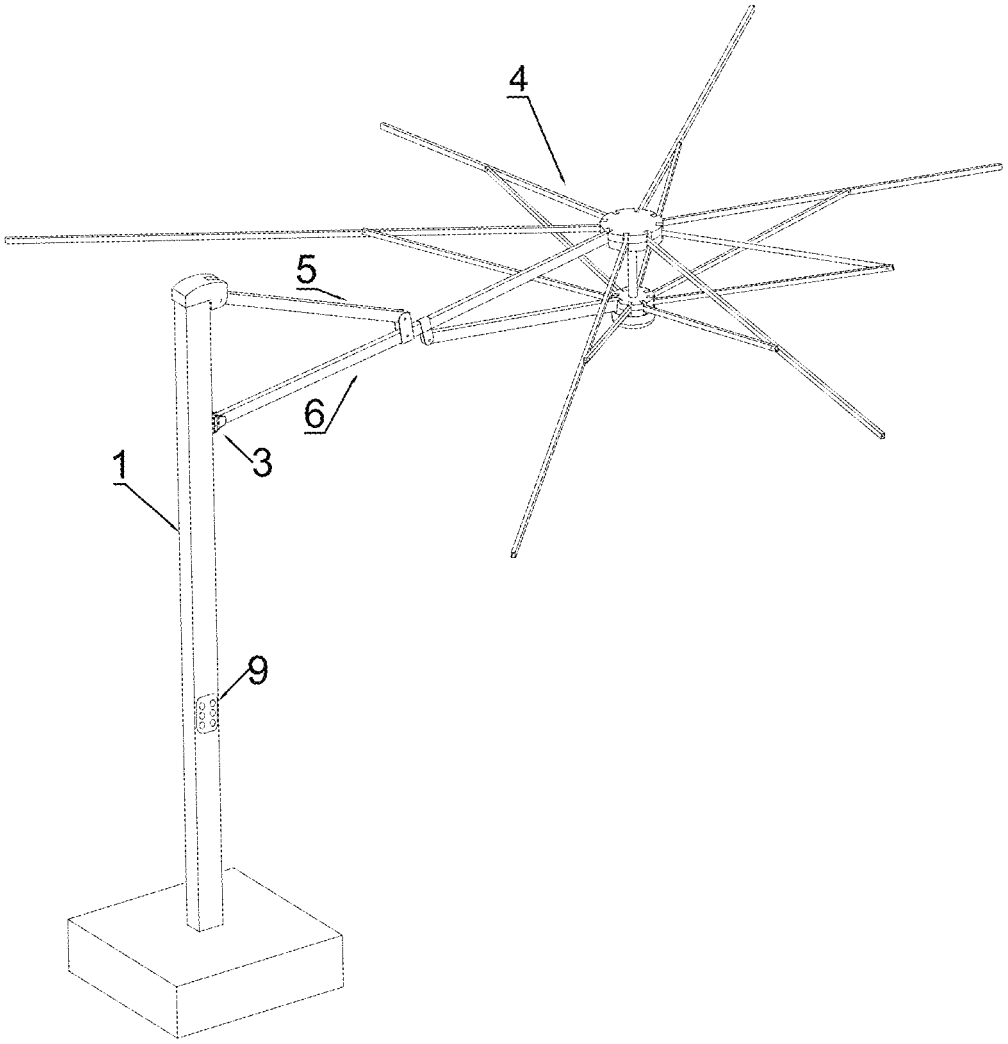
FIG. 1 is a first perspective view of an electric umbrella according to Embodiment 1 of the present invention.
Figure 2:
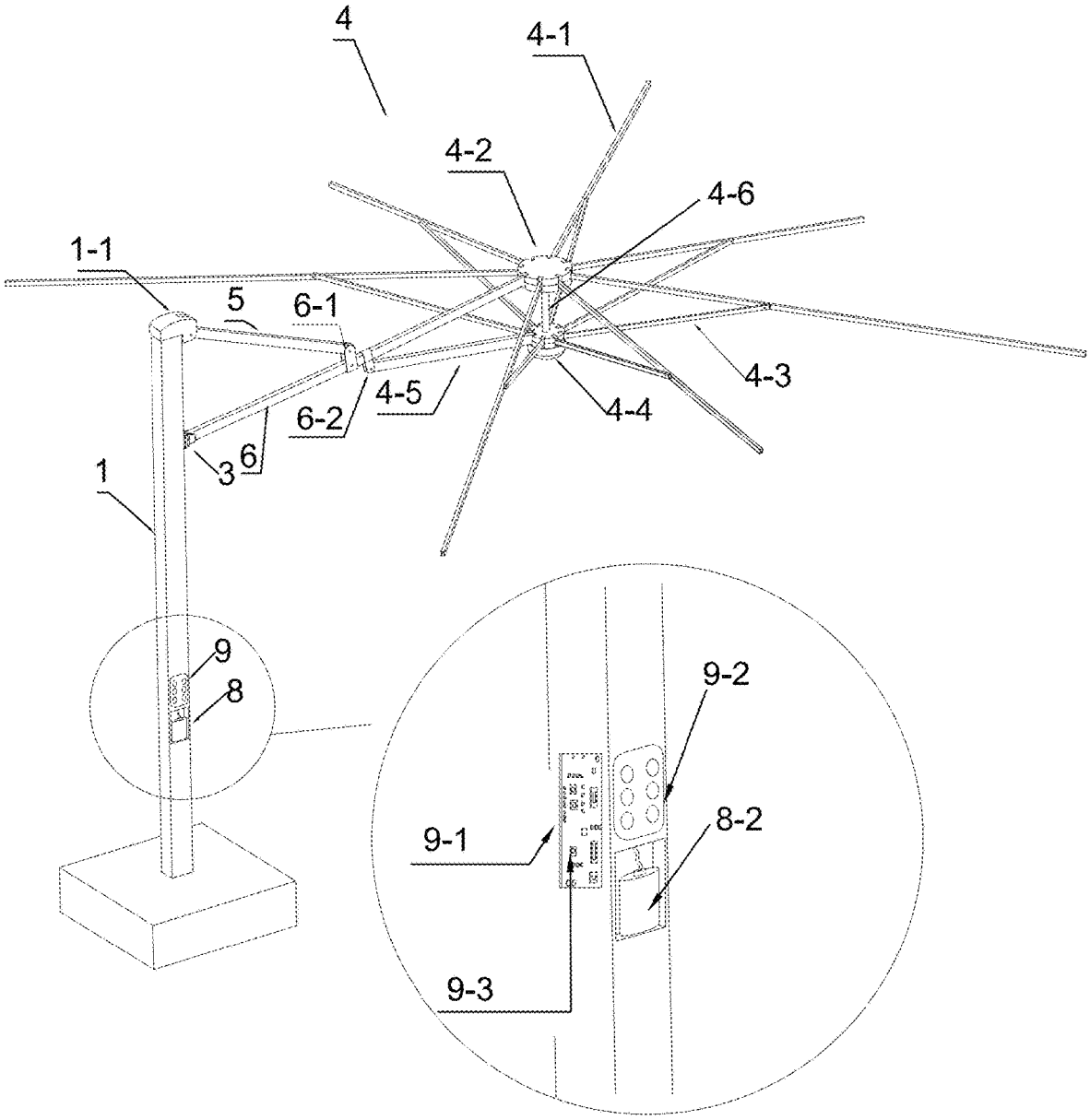
FIG. 2 is a second perspective view of the electric umbrella according to Embodiment 1 of the present invention.
Figure 3:
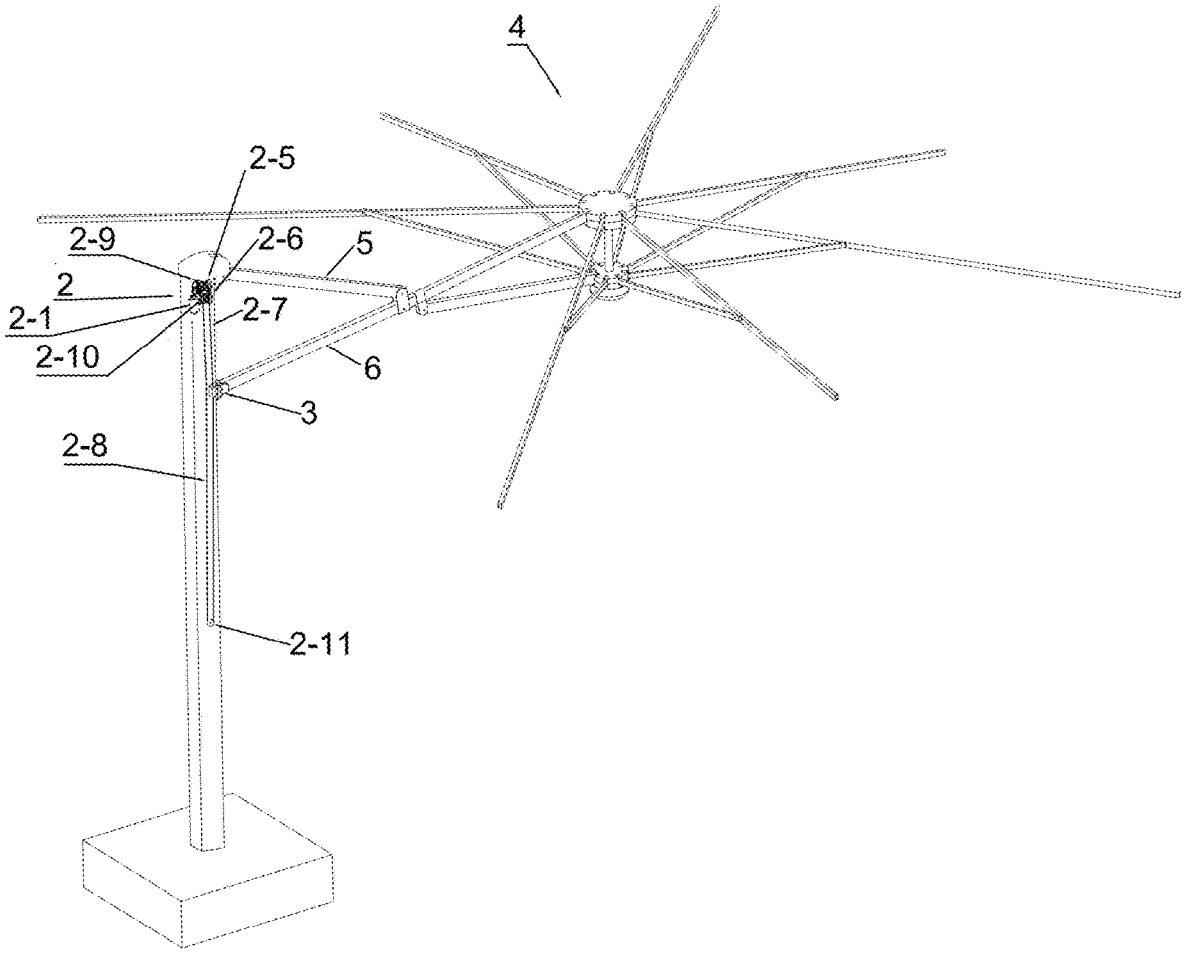
FIG. 3 is a third perspective view of the electric umbrella according to Embodiment 1 of the present invention.
Figure 4:
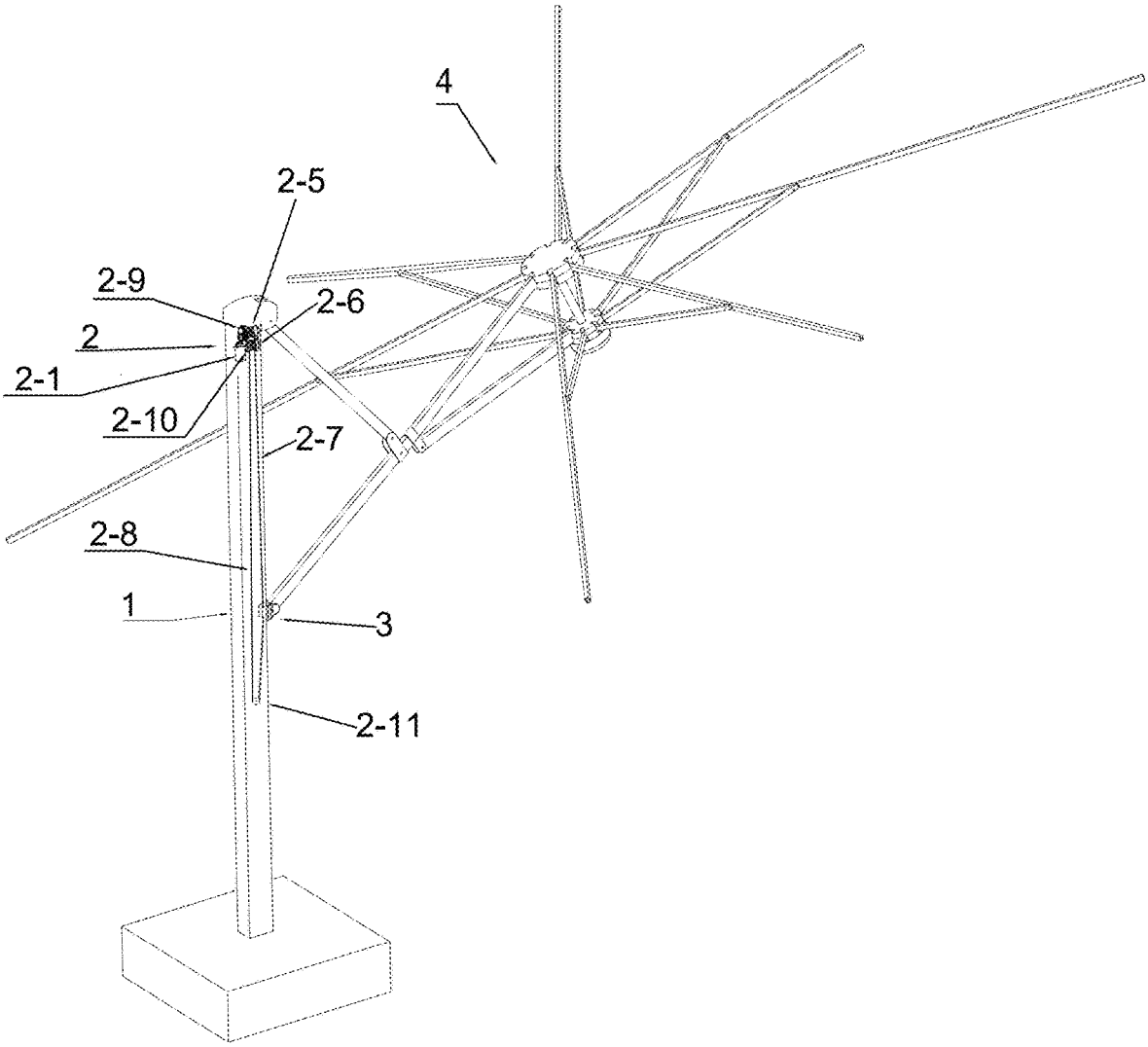
FIG. 4 is a fourth perspective view of the electric umbrella according to Embodiment 1 of the present invention (the angle of the umbrella frame is adjusted)
Figure 5:
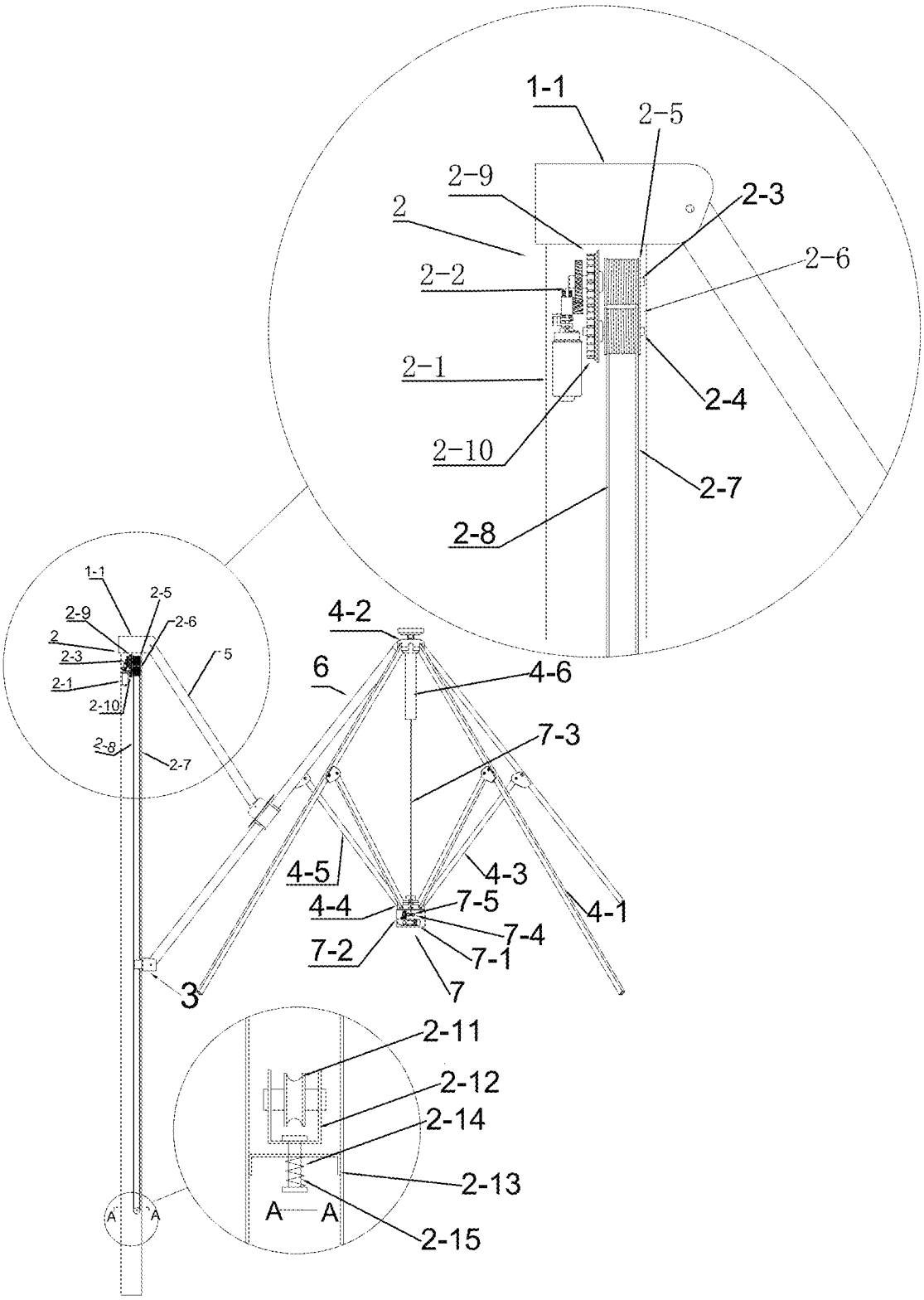
FIG. 5 is a side view of the electric umbrella according to Embodiment 1 of the present invention when the umbrella frame is close to a folded state.
Figure 6:
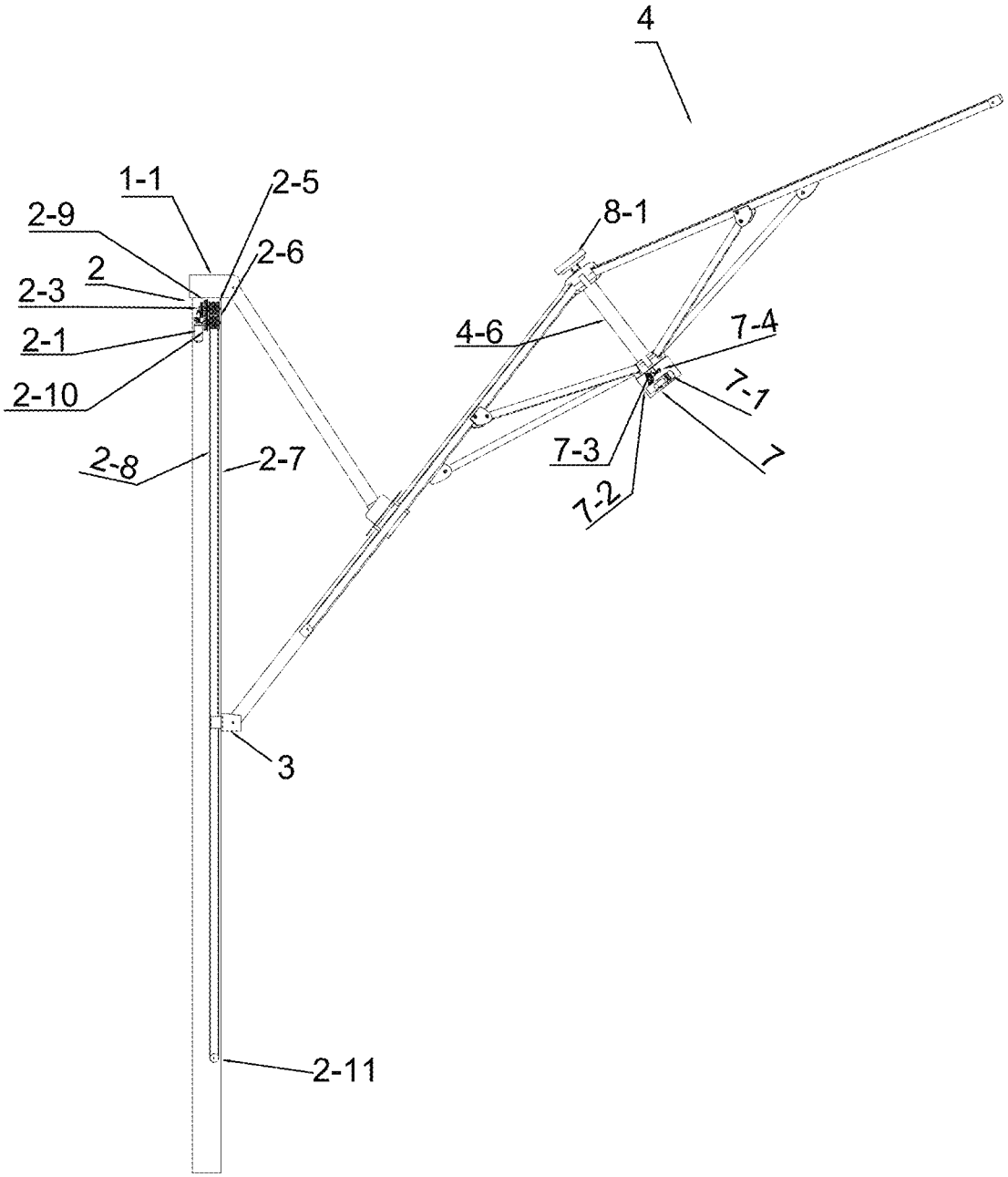
FIG. 6 is a side view of the electric umbrella according to Embodiment 1 of the present invention when the angle of the umbrella frame is adjusted.
Figure 7:
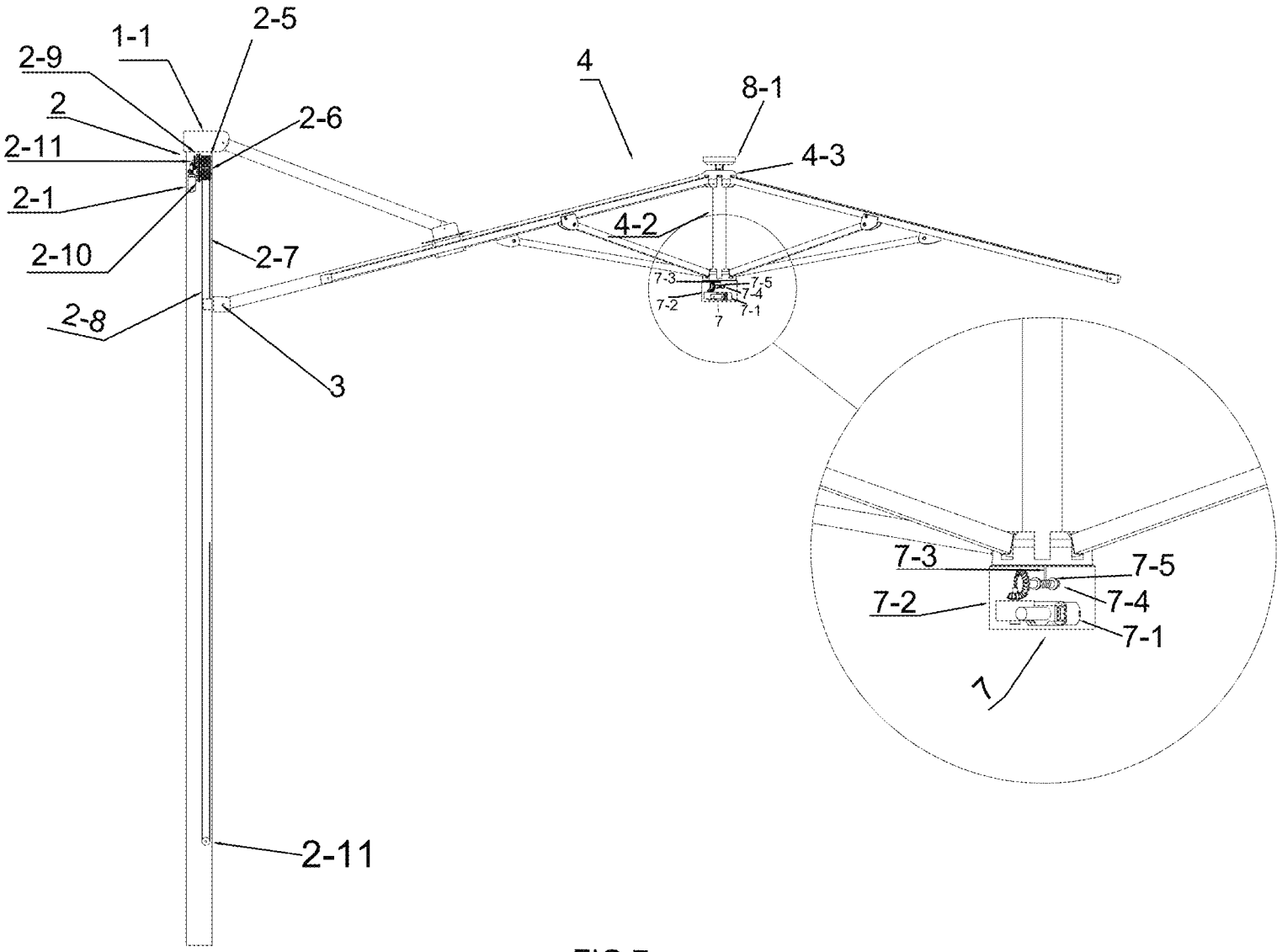
FIG. 7 is a side view of the electric umbrella according to Embodiment 1 of the present invention when the umbrella frame is in an unfolded state.
Figure 8:
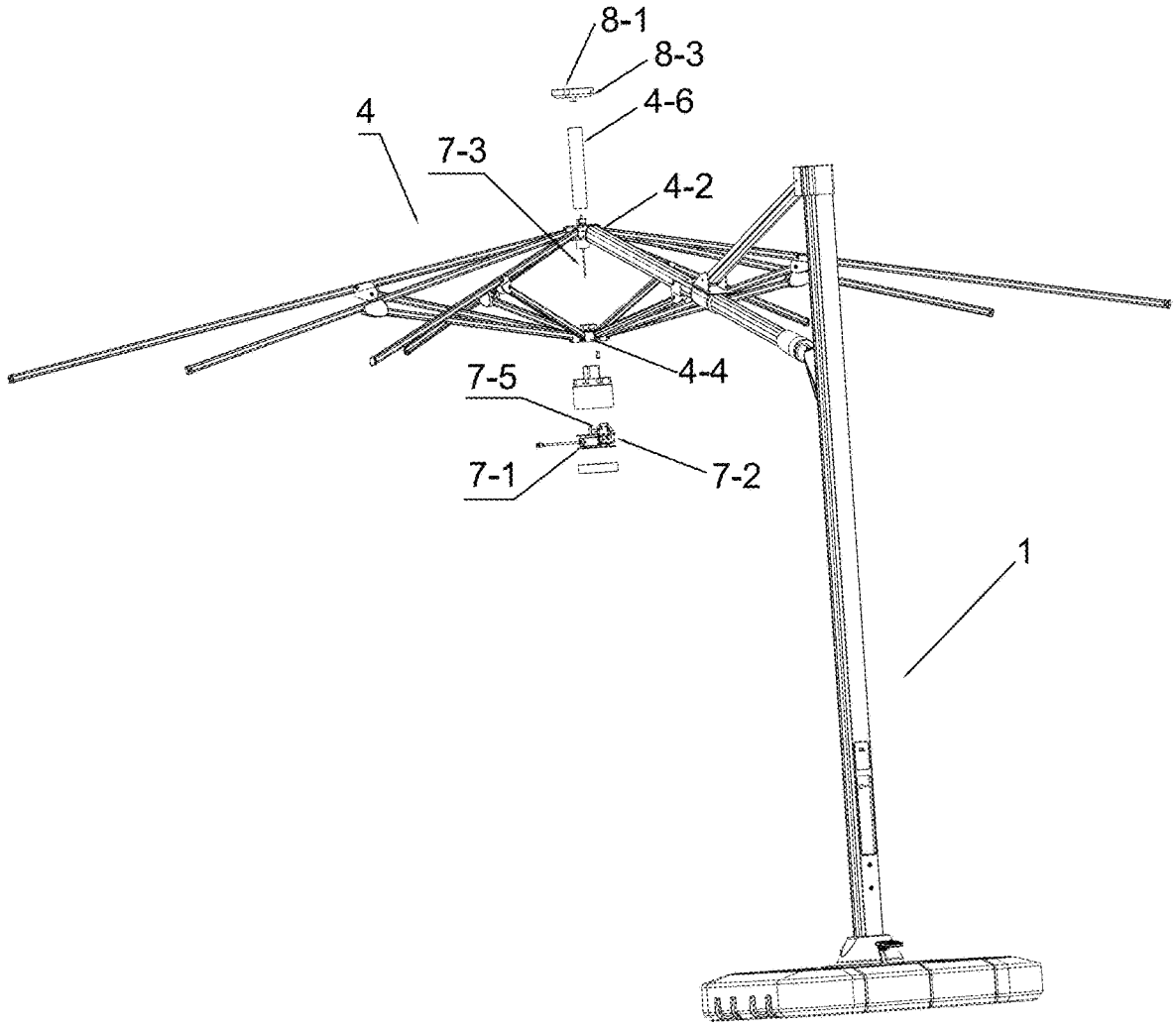
FIG. 8 is a first exploded view of the partial electric umbrella according to Embodiment 1 of the present invention.
Figure 9:
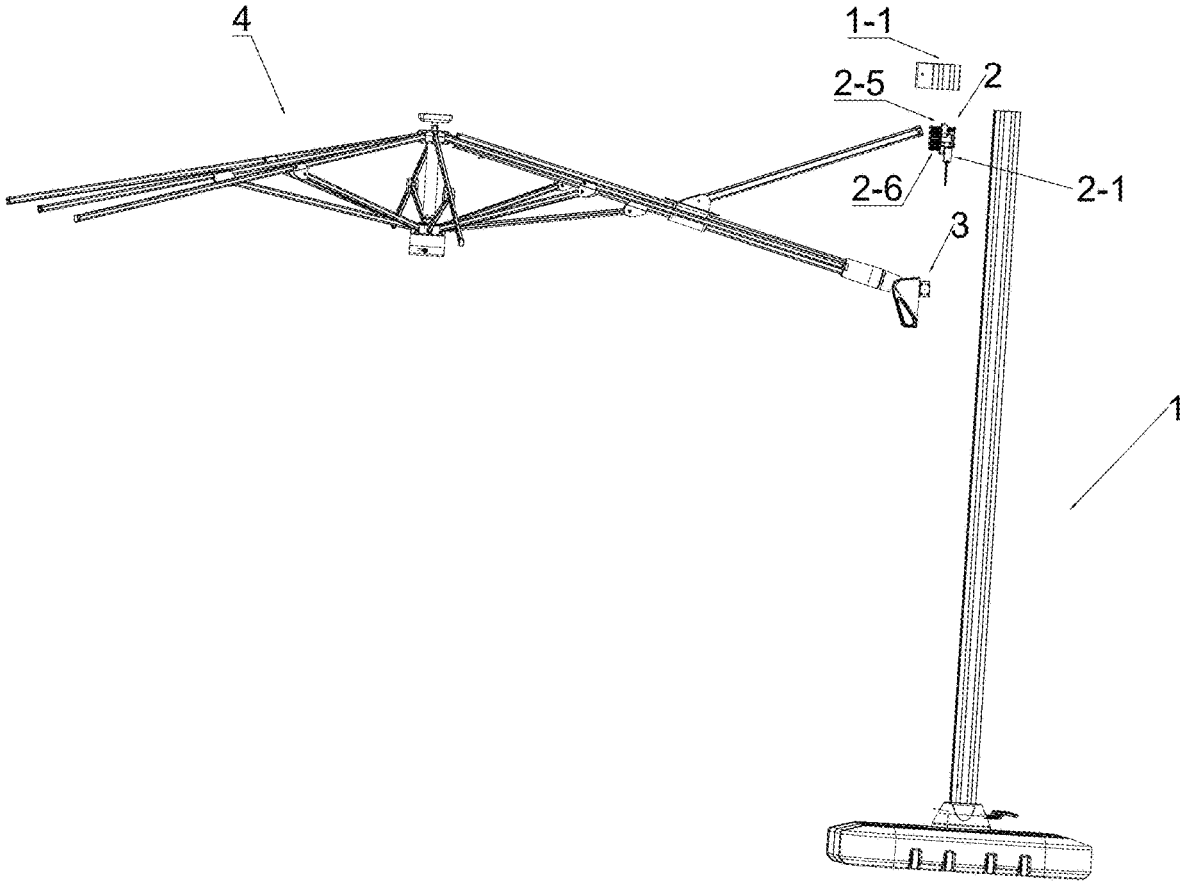
FIG. 9 is a second exploded view of the partial electric umbrella according to Embodiment 1 of the present invention.
Figure 10:
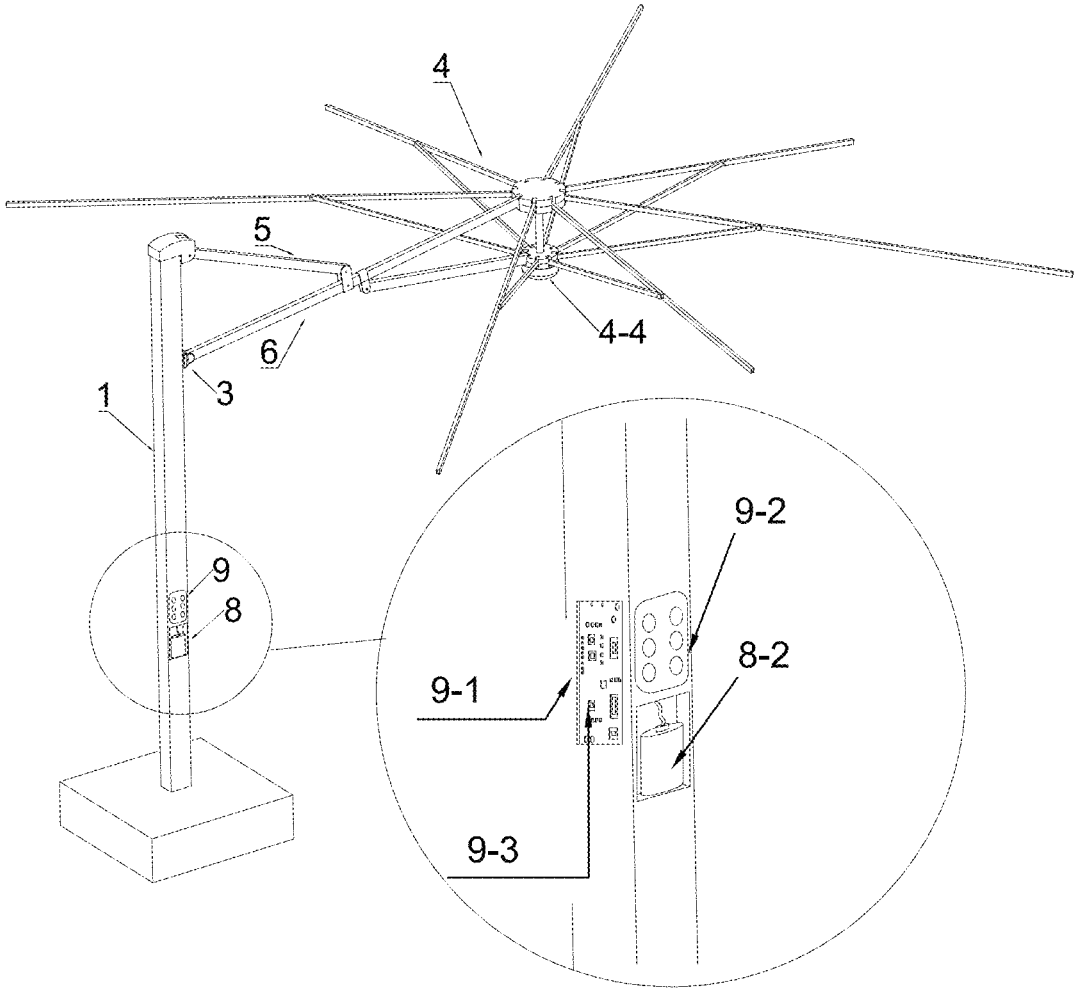
FIG. 10 is a first perspective view of an electric umbrella according to Embodiment 2 of the present invention.
Figure 11:
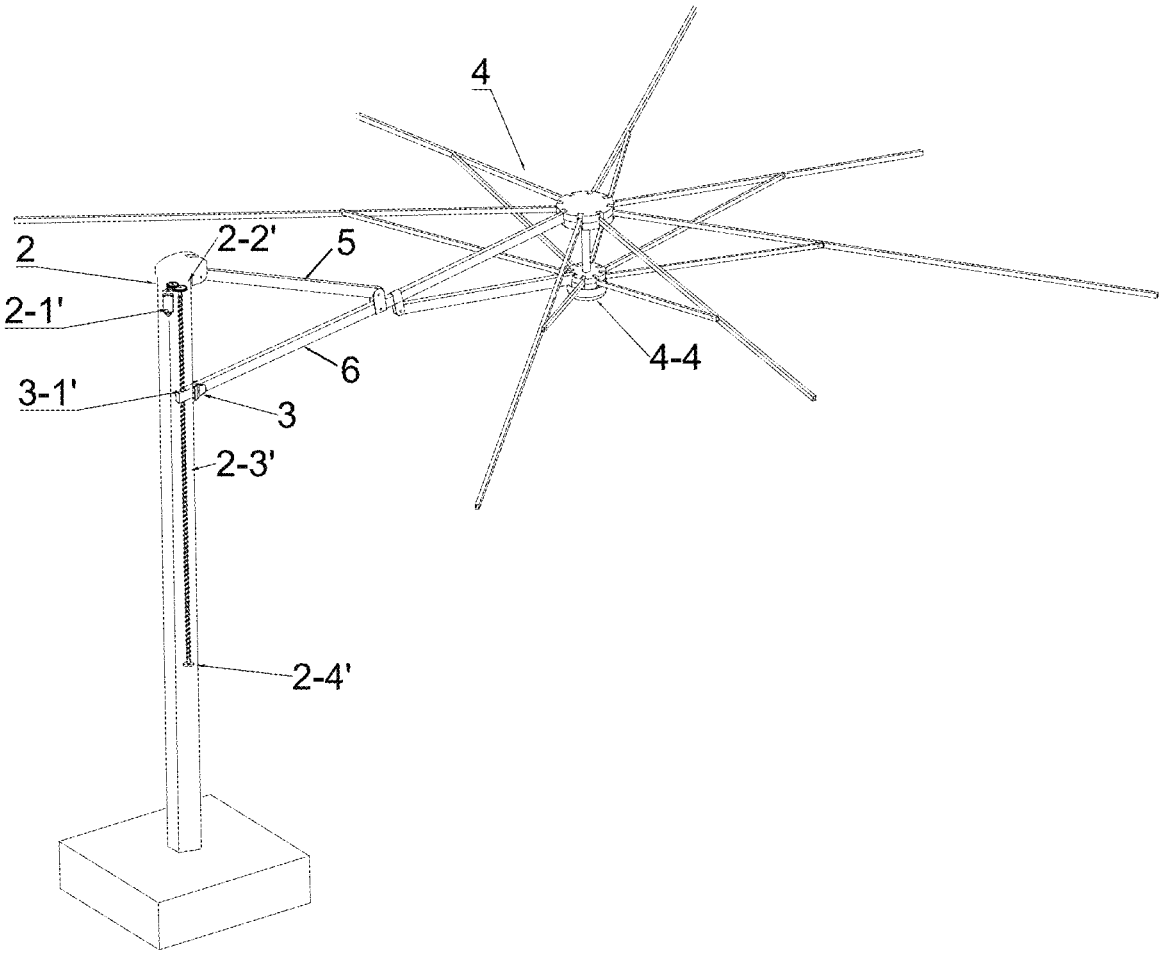
FIG. 11 is a second perspective view of the electric umbrella according to Embodiment 2 of the present invention.
Figure 12:
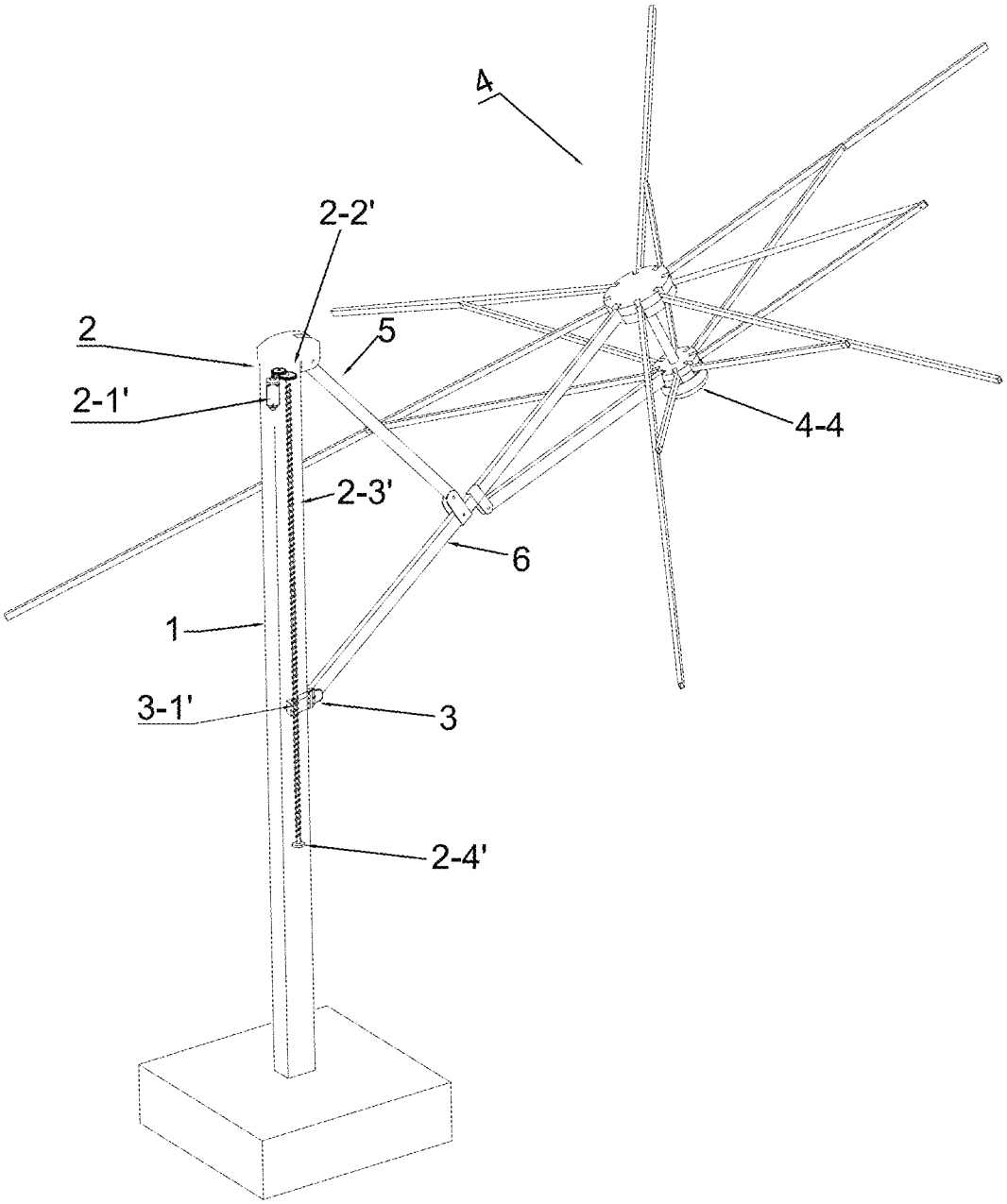
FIG. 12 is a third perspective view of the electric umbrella according to Embodiment 2 of the present invention (the angle of the umbrella frame is adjusted)
Figure 13:
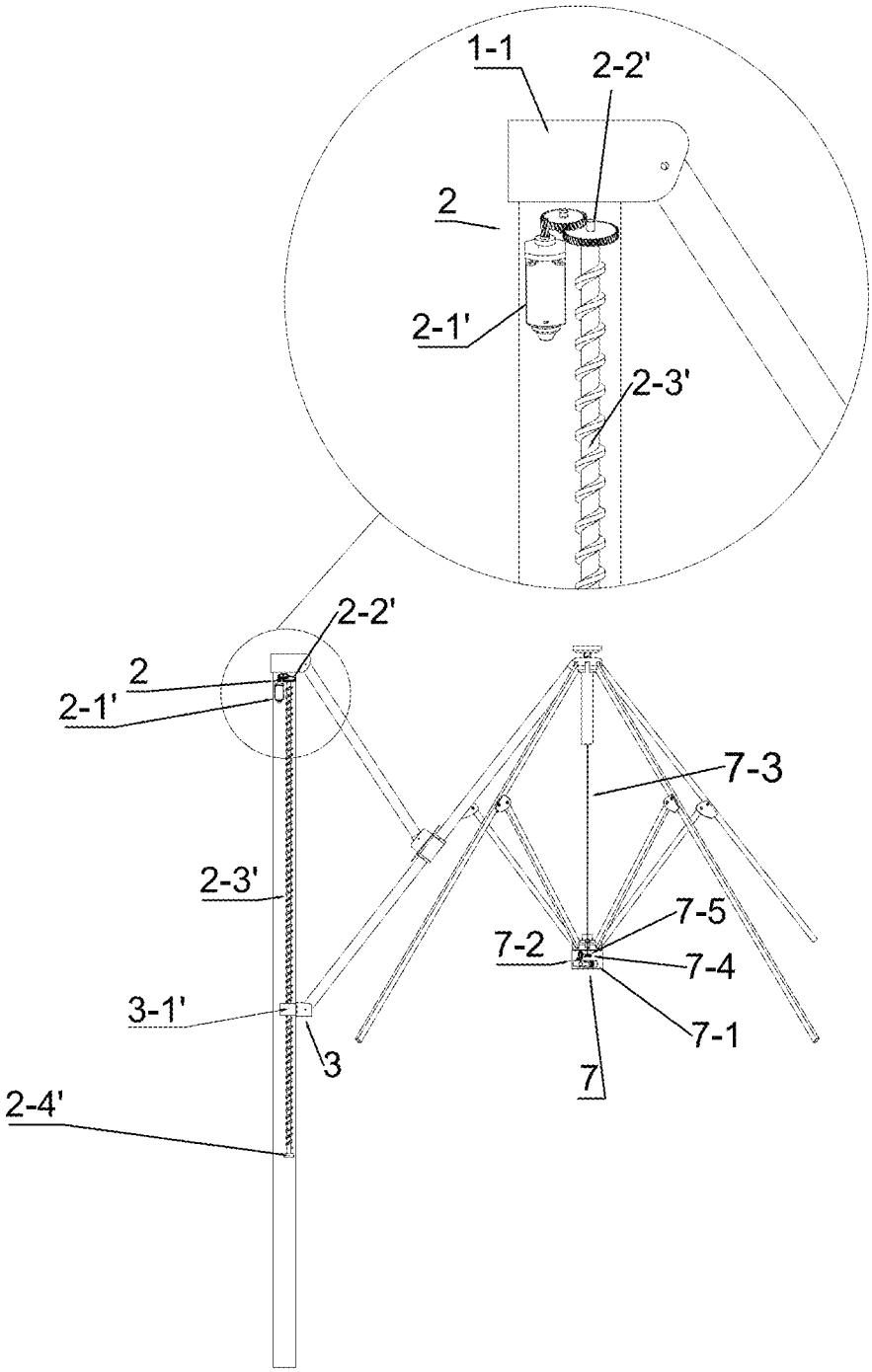
FIG. 13 is a side view of the electric umbrella according to Embodiment 2 of the present invention when the umbrella frame is close to a folded state.
Figure 14:
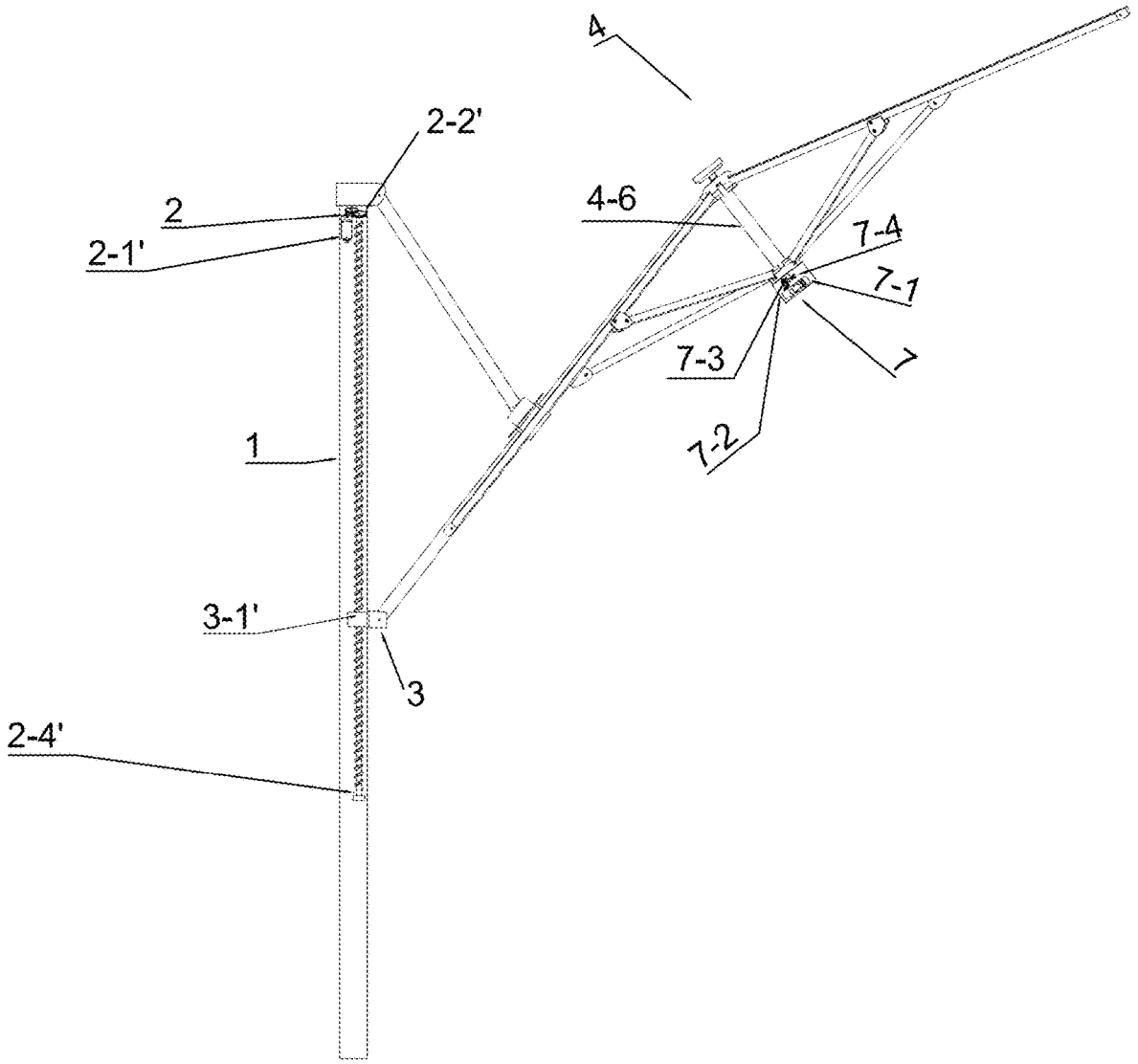
FIG. 14 is a side view of the electric umbrella according to Embodiment 2 of the present invention when the angle of the umbrella frame is adjusted.
Figure 15:
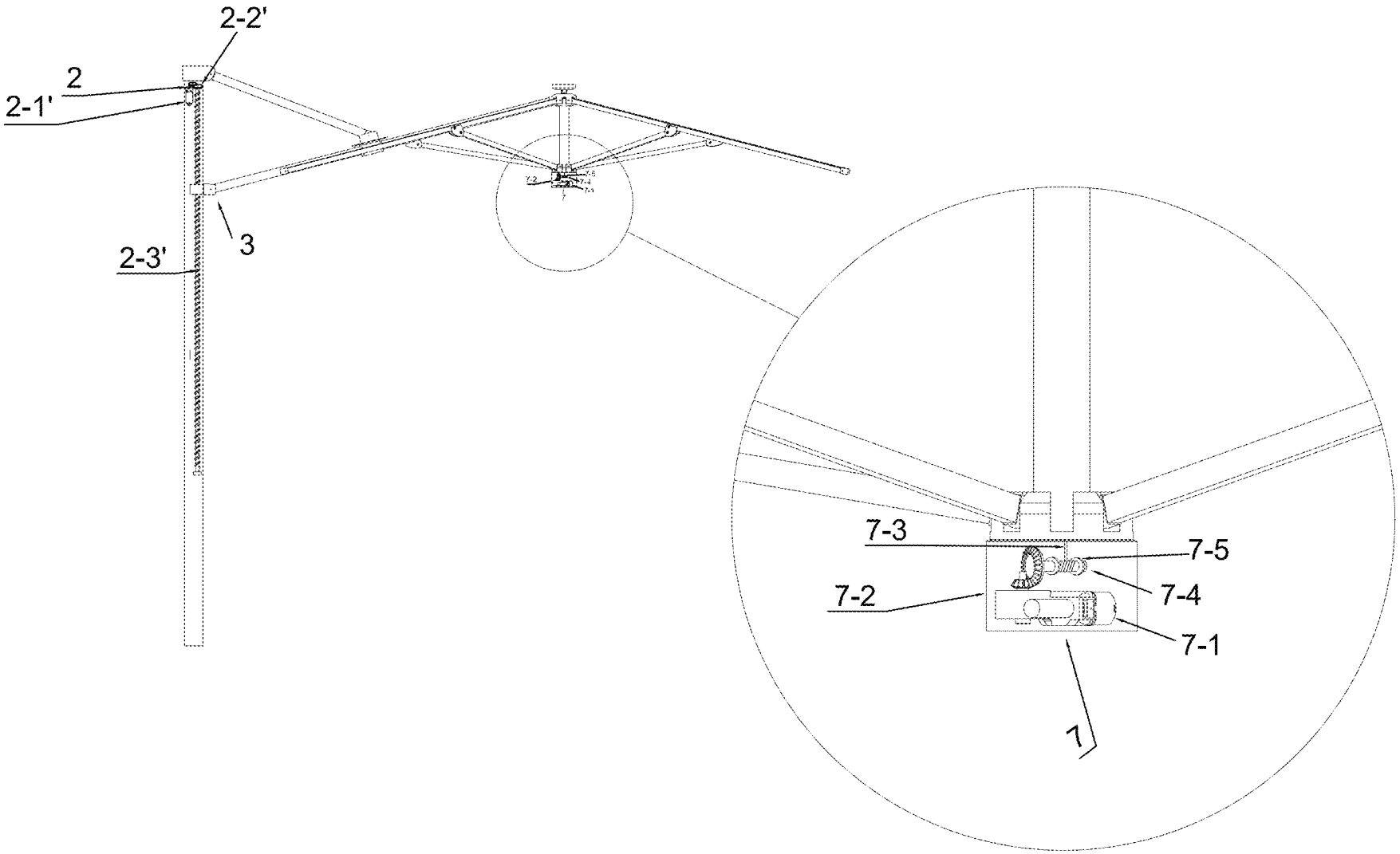
FIG. 15 is a side view of the electric umbrella according to Embodiment 2 of the present invention when the umbrella frame is in an unfolded state.

The present invention will be further described below in detail by embodiments with reference to the accompanying drawings.

It should be pointed that in the description of the present invention, when a component is "fixed to" or "arranged on" another component, it means this component directly or indirectly arranged on another component; when a component is "connected to" another component, it means this component directly or indirectly connected to another component.

It should be noted that in the description of the present invention, the terms "length", "width", "up, down", "front, back", "front, back", "vertical, horizontal", "top, bottom", "inner, outer", etc. to describe a direction or position based on the accompanying drawings are only used for describe the present invention and simplify the description, instead of indicating that devices or elements must have particular orientation or must be constructed and operated in a particular orientation, so that these terms should not be used as restrictions.

In addition, terms such as "first" and "second" are only used for better description and should not be understood as indicating or implying importance of each component or as implicitly indicating the quantity of the technical features. Therefore, a feature defined as "first" or "second" may explicitly or implicitly comprises one or more such features. In the description of the present invention, "a plurality of" means two or more than two, except that a specific limitation is set.

Embodiment 1

FIGS. 1-9 show a first preferred embodiment of an electric umbrella of the present invention. The electric umbrella powered by solar energy comprises a column 1 having a top and a bottom; a first driving assembly 2; a slider 3 slidably disposed on the column 1; an umbrella frame 4; a second driving assembly 7; a power source 8; and a control module 9 regarding as main components of the electric umbrella.

The first driving assembly 2 comprises a first motor 2-1, a first driving gears 2-2, a first output shaft 2-3, a second output shaft 2-4, a first rope winding wheel 2-5, a second rope winding wheel 2-6, a first traction rope segment 2-7 having a first end and a second end and a second traction rope segment 2-8 having a first end and a second end regarding as main components of the first driving assembly 2.

The umbrella frame 4 comprises a first connecting rod 5 having a first end and a second end, a second connecting rod 6 having an upper end, a middle portion and a lower end, a plurality of long rods 4-1, a long rod nest 4-2, a plurality of short rods 4-3, a short rod nest 4-4, a large support rod 4-5 and a central pipe 4-6 connecting to either the long rod nest 4-2 or the short rod nest 4-4, the first end of the first connecting rod 5 rotatably connects to a hinge 1-1 arranged at the top of the column 1 and the second end of the first connecting rod 5 rotatably connects to a middle-upper hinge 6-1 arranged at the middle of the second connecting rod 6, the lower end of the second connecting rod 6 is hinged to the slider 3 and the upper end thereof rotatably connects to the long rod nest 4-2, the middle-upper hinge 6-1 is hinged to the second end pf first connecting rod 5 and a middle-lower hinge 6-2 rotatably connects to the large support rod 4-5. One end of each short rod 4-3 rotatably connects to the short rod nest 4-4 and the other end thereof rotatably connects to a middle portion of corresponding long rod 4-1, the long rod 4-1 has a top end which rotatably connects the long rod nest 4-2, one end of the large support rod 4-5 rotatably connects to the short rod nest 4-4 and the other end thereof rotatably connects to the middle-lower hinge 6-2 of the second connecting rod 6, the central pipe 4-6 has a top end which connects to the long rod nest 4-2 or connects to the short rod nest 4-4.

, The second driving assembly 7 is disposed on the short rod nest 4-4 of the umbrella frame 4, and the second driving assembly 7 comprises a second motor 7-1 having an output, a second driving gears 7-2 having an input and an output and a third traction rope segment 7-3 regarding as main components of the second driving assembly 7.

The power source 8 comprises a solar photovoltaic panel 8-1, a solar module 8-3 having two ends and an energy storage battery 8-2; the solar module 8-3 is arranged between the solar photovoltaic panel 8-1 and the energy storage battery 8-2, the solar photovoltaic panel 8-1 is mounted on a top of the umbrella, and fully receives solar energy from any angle all day long, the solar module 8-3 converts solar energy into electric energy to charge the energy storage battery 8-2, the energy storage battery 8-2 may also be charged by the solar energy, or removed to be charged.

The control module 9 is embedded in the column 1, and is electrically connected to the first driving assembly 2, the second driving assembly 7 and the power source 8, respectively. The control module 9 comprises a control main board 9-1, a control panel 9-2, and a wireless control module 9-3. The control main board 9-1 is respectively connected to the first driving assembly 2, the second driving assembly 7 and the power source 8, so as to control the start and stop of the first driving assembly 2 and the second driving assembly 7, and simultaneously controls the retraction and release lengths of a first traction rope segment 2-7, a second traction rope segment 2-8 and the third traction rope segment 7-3. The wireless control module 9-3 may be controlled by a wireless remote controller or a mobile phone. The power source 8 provides electrical energy for all components requiring electrical energy.

The first driving assembly 2 is mounted at one end (such as the top end) of the column 1, and the first rope winding wheel 2-5 and a first gear 2-9 are mounted on the first output shaft 2-3 of the first driving assembly 2; and the second rope winding wheel 2-6 and a second gear 2-10 are mounted on the second output shaft 2-4 of the first driving assembly 2. The first gear 2-9 meshes with the second gear 2-10, and the first gear 2-9 drives the second gear 2-10 to rotate. A rope-guide pulley 2-11 is mounted on the other end (such as the bottom end) of the column 1, the rope-guide pulley 2-11 is mounted on a rope-guide pulley frame 2-12, the rope-guide pulley frame 2-12 is movably mounted on a rope-guide pulley frame fixing plate 2-13 fastened by a connecting pin 2-14 having a limiting portion at one end of the connecting pin 2-14, the rope-guide pulley frame fixing plate 2-13 is fixed inside the column 1, a spring 2-15 is mounted on the connecting pin 2-14 which is arranged below the rope-guide pulley frame 2-12, and is used for automatically tensioning the traction rope. The rope-guide pulley frame fixing plate 2-13 is fixed in the column 1, the slider 3 is sleeved on a middle portion of the column 1 so that the slider 3 is capable of moving along the column 1, one end of the slider 3 is rotatably connected to the lower end of the second connecting rod 6 through a connecting point. The first rope winding wheel 2-5 is wound around the first traction rope segment 2-7, the second rope winding wheel 2-6 is wound around the second traction rope segment 2-8, and the first end of the first traction rope segment 2-7 connects to the first rope winding wheel 2-5, and the second end thereof connects to the slider 3; the first end of the second traction rope segment 2-8 connects to the second rope winding wheel 2-6, and a traction rope slightly longer than the sliding distance of the slider 3 on the upright column 1 is pre-wound around the second rope winding wheel 2-6, and the second end of the second traction rope segment 2-8 turns around the rope-guide pulley frame 2-12 arranged in a lower end of the column and connects to the slider 3, and the first traction rope segment 2-7 and the second traction rope segment 2-8 are in circle and the slider 3 is as a beginning point and a terminal point.

In this way, the first motor 2-1 is connected to the first rope winding wheel 2-5 through the first output shaft 2-3 on the first driving gear 2-2; the first rope winding wheel 2-5 is connected to the second rope winding wheel 2-6 via the meshing of the first gear 2-9 and the second gear 2-10; the first rope winding wheel 2-5 connects to the slider 3 via the first traction rope segment 2-7, the second rope winding wheel 2-6 connects to the slider 3 by the second traction rope segment 2-8 via the rope-guide pulley 2-11, the slider 3 rotatably connects to the second connecting rod 6; and generally, the column 1 has a sliding groove on a surface of the column 1, so that the slider 3 can be slidable in the sliding groove, facilitating connection between the slider, the traction rope and the second connecting rod 6.

When the first motor 2-1 starts to work, the output shafts of the first driving assembly 1 are driven to rotate, rotation of the output shafts drives the first rope winding wheel 2-5 and the second rope winding wheel 2-6 to rotate, and rotation of the first rope winding wheel 2-5 and the second rope winding wheel 2-6 drives the slider 3 to be slidable along the column 1.

Specifically, when the first rope winding wheel 2-5 rotates in a forward direction, the rotation of the first gear 2-9 and the second gear 2-10 drives the second rope winding wheel 2-6 to rotate in a reverse direction, a segment of the second traction rope segment 2-8 which is pre-wound on the second rope winding wheel 2-6 is released round and round along with the rotation of the second rope winding wheel 2-6, and at the same time, the first traction rope segment 2-7 is wound round and round on the first rope winding wheel 2-5 along with the rotation of the first rope winding wheel 2-5, the slider 3 is driven to move upward along the column 1 so that the second connecting rod 6 is driven to move upward along the column 1, adjusting a pitch angle of the umbrella canopy and unfolding the umbrella. When the first rope winding wheel 2-5 rotates in a reverse direction, the rotation of the first gear 2-9 and the second gear 2-10 drives the second rope winding wheel 2-6 to rotate in a forward direction, a segment of the first traction rope segment 2-7 which has been wound on the first rope winding wheel 2-5 is released round and round along with the rotation of the first rope winding wheel 2-5, and at the same time, the second traction rope segment 2-8 is wound round and round again on the second rope winding wheel 2-6 along with the rotation of the second rope winding wheel 2-6, the slider 3 is driven to move downward along the column 1 so that the second connecting rod 6 is driven to move downward along the column 1, adjusting the pitch angle of the umbrella canopy and folding the umbrella. Such operations fulfill various use functions of the umbrella.

The key design of the present invention is: the second driving assembly 7 comprising a second motor 7-1, a second driving gear 7-2, a third traction rope segment 7-3 having a first end and a second end, a third output shaft 7-4 and a third rope winding wheel 7-5 is arranged on a bottom surface of the short rod nest 4-4, the second motor 7-1 of the second driving assembly 7 connects to the second driving gear 7-2, the second driving gear 7-2 connects to the third output shaft 7-4, and the third rope winding wheel 7-5 is mounted on the third output shaft 7-4; the first end of the third traction rope segment 7-3 connects to the third rope winding wheel 7-5, and the second end thereof passes through a central hole formed on an upper surface of the short rod nest 4-4, and then passes through the hollow central pipe 4-6 to connect to the long rod nest 4-2. The second driving assembly 7 may have a protective housing, which connects to the short rod nest 4-4 and covers components such as the second motor 7-1, the second driving gear 7-2, the third output shaft 7-4, and the third rope winding wheel 7-5, etc.

When the second driving assembly 7 starts to work, the second motor 7-1 rotates in a forward direction, the third rope winding wheel 7-5 is driven to rotate in the forward direction, retracting the third traction rope segment 7-3, thereby driving the short rod nest 4-4 to move upward; upward movement of the short rod nest 4-4 urges the plurality of short support rods 4-3 to unfold, applying a support force to the plurality of long rods 4-1, so that the long rods 4-1 are propped open outwards and lifted upward to open the umbrella canopy. When the short rod nest 4-4 moves upward and attaches the central pipe 4-6, the second motor 7-1 stops rotating, which may be realized by a travel switch, a magnetic control switch or a Hall element. When the second motor 7-1 rotates in a reverse direction, the third rope winding wheel 7-5 is driven to rotate in the reverse direction, releasing the third traction rope segment 7-3; after being released, under the action of gravity, the third traction rope segment 7-3 drives the short rod nest 4-4 to move downward, driving the short rods 4-3 to be retracted inwards, so as to fold the umbrella canopy.

Folding/unfolding of the umbrella canopy and angle adjustment of the electric umbrella can be finished without a lot effort of human, and the electric umbrella of the present invention enables automatic folding/unfolding of the umbrella canopy and angle adjustment of the electric umbrella, thereby saving the labor of users and improving the user experience.

When the electric umbrella needs to be opened, the second motor 7-1 is started via the control module, the second motor 7-1 operates to drive the third rope winding wheel 7-5 on the third output shaft 7-4 of the second driving gear 7-2 to rotate, the third rope winding wheel 7-5 rotates and tightens the third traction rope segment 7-3, and the third traction rope segment 7-3 is tightened to drive the short rod nest 4-4 to move upward, so that the umbrella frame 4 is opened.

When the electric umbrella needs to be folded, the second motor 7-1 is started via the control module, the second motor 7-1 operates to drive the third rope winding wheel 7-5 on the third output shaft 7-4 of the second driving gear 7-2 to rotate, the third rope winding wheel 7-5 rotates and releases the third traction rope segment 7-3, and the umbrella frame 4 is automatically folded under the action of gravity.

When the angle of the electric umbrella needs to be adjusted, the first motor 2-1 is started by the control module, the first motor 2-1 operates to drive the first rope winding wheel 2-5 on the first output shaft 2-3 of the first driving gear 2-2 to rotate, and the first rope winding wheel 2-5 rotates in forward and reverse directions to adjust the retraction and release of the first traction rope segment 2-7 and the second traction rope segment 2-8, thereby changing position of the slider 3; and the position change of the slider 3 drives the position of the second connecting rod 6 to change synchronously, thereby enables the change and adjustment of the angle of the umbrella frame 4.

The electric umbrella of the present invention can control the first driving assembly 2 and the second driving assembly 7 step by step by the control module, so that the electric umbrella is automatically folded/unfolded step by step and the angle of the umbrella frame 4 is adjusted automatically.

Embodiment 2

FIGS. 10-15 show a second preferred embodiment of an electric umbrella of the present invention, the electric umbrella powered by solar energy differs from Embodiment 1 in that: a first driving assembly 2 is mounted at an upper end of a column 1, the first driving assembly 2 is driven by a first motor 2-1', a transmission screw 2-3' has a first end and a second and an output shaft 2-2' of the first driving assembly 2 connects to the first end of the transmission screw 2-3'; a nut 3-1' is arranged on the transmission screw 2-3' and is fixed on the slider 3, the slider 3 is sleeved on a middle portion of the column 1 so that the slider 3 is capable of moving along the column 1, and the slider 3 is rotatably hinged to a second connecting rod 6. A bearing 2-4' is mounted on the second end of the transmission screw 2-3', that is, a middle lower portion of the column 1; when the first motor 2-1' starts to work, the output shaft 2-2' of the driving assembly 2 is driven to rotate, rotation of the output shaft 2-2' drives the transmission screw 2-3' to rotate, and the rotation of the transmission screw 2-3' drives the nut 3-1' to move along the transmission screw 2-3'.

When the first motor 2-1' rotates in a forward direction, the transmission screw 2-3' is driven to rotate in the forward direction, driving the nut 3-1' to move upward along the transmission screw 2-3', so that the slider 3 is driven to move upward along the column 1, driving the second connecting rod 6 to move upward, adjusting a pitch angle of an umbrella canopy and unfolding the umbrella.

When the first motor 2-1' rotates in a reverse direction, the transmission screw 2-3' is driven to rotate in the reverse direction, driving the nut 3-1' to move downward along the transmission screw 2-3', so that the slider 3 is driven to move downward along the column 1, driving the second connecting rod 6 to move downward, adjusting the pitch angle of the umbrella canopy and folding the umbrella.

Other structure of the second embodiment is similar to Embodiment 1.

Embodiment 3

Figure 16:
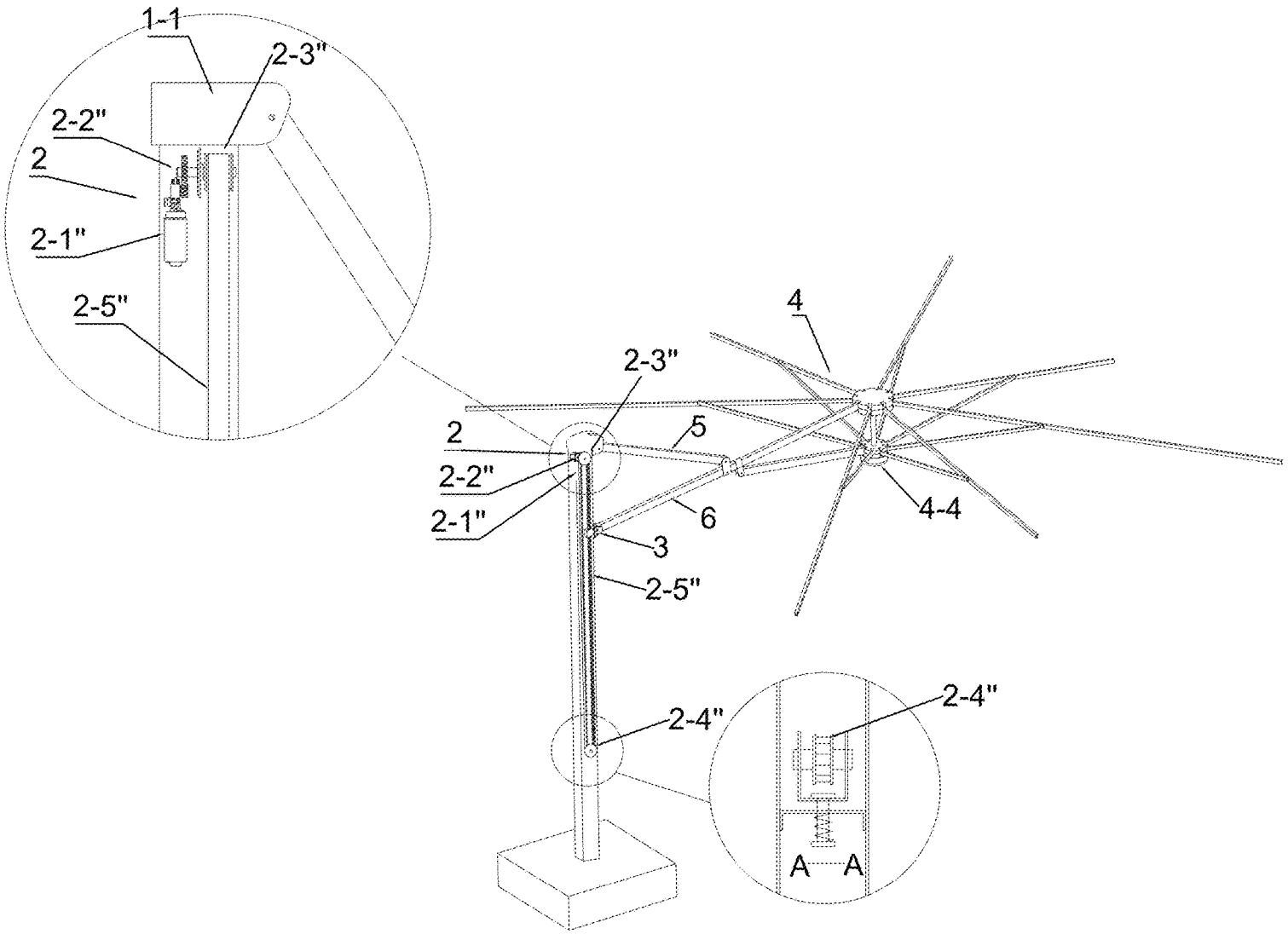
FIG. 16 is a first perspective view of an electric umbrella according to Embodiment 3 of the present invention.
Figure 17:
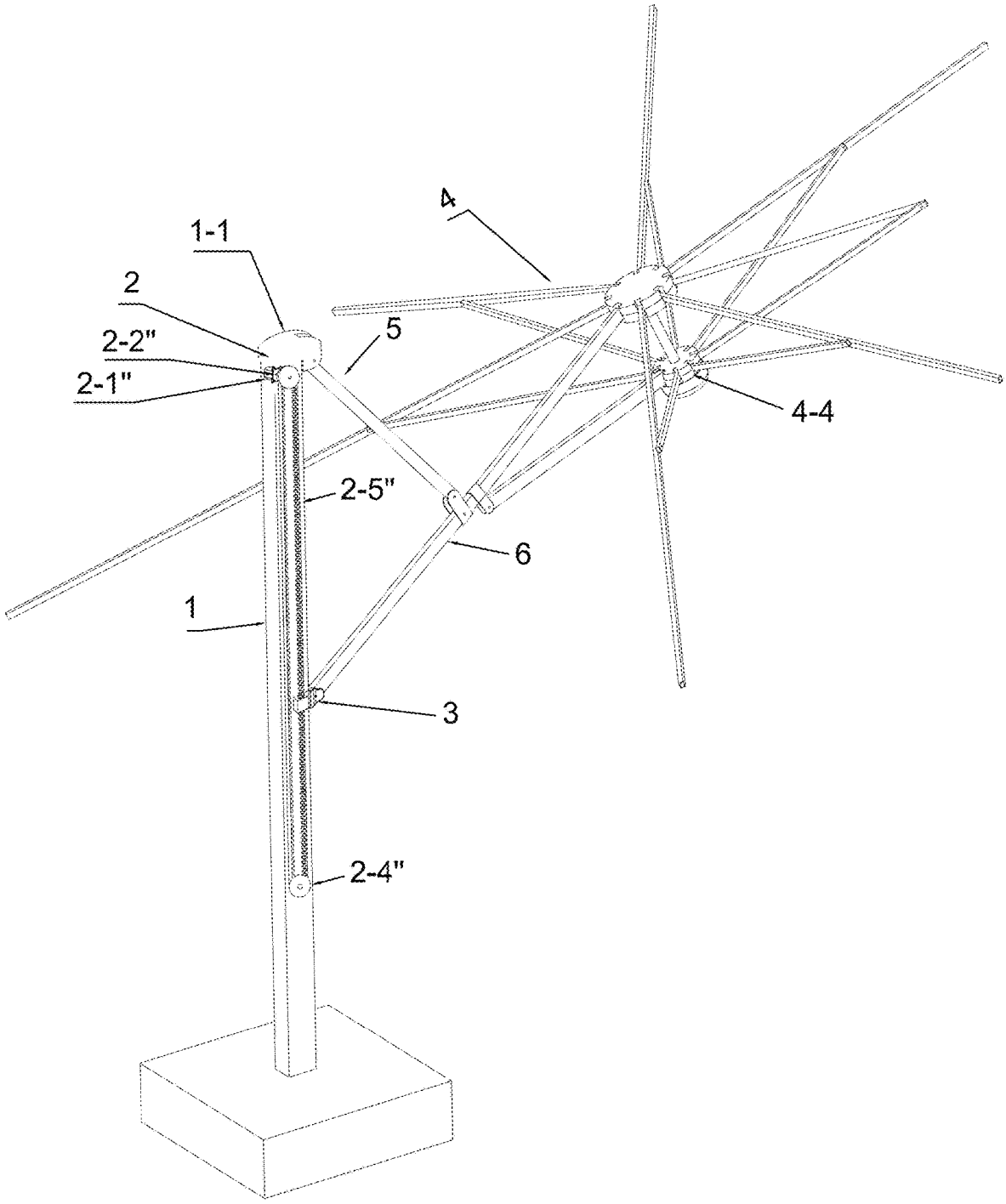
FIG. 17 is a second perspective view of the electric umbrella according to Embodiment 3 of the present invention.
Figure 18:
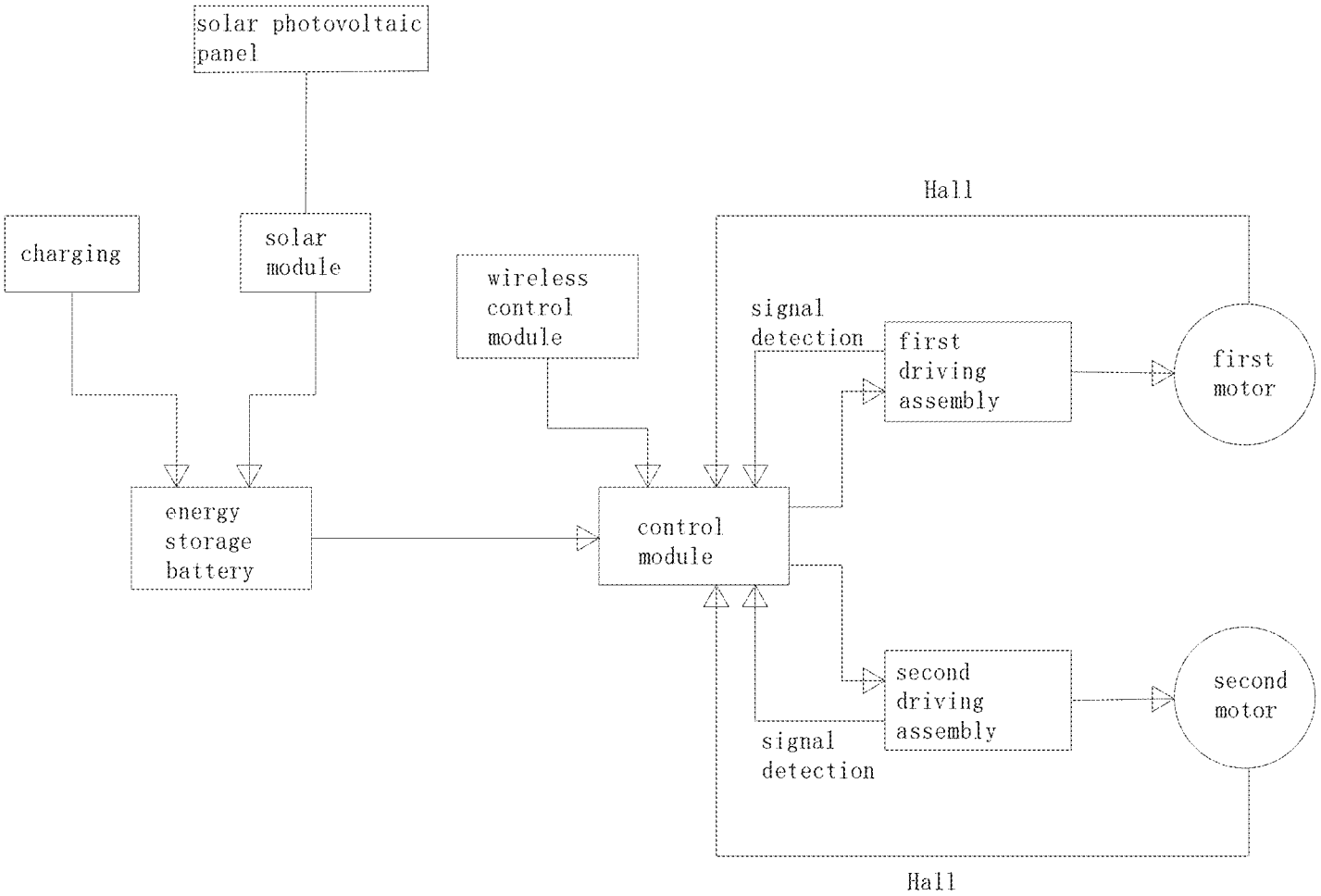
FIG. 18 is a circuit module diagram of the electric umbrella according to Embodiment 1, Embodiment 2 and Embodiment 3 of the present invention.

FIGS. 16-17 show a third preferred embodiment of an electric umbrella of the present invention, the electric umbrella powered by solar energy differs from Embodiment 1 in that: a first driving assembly 2 is mounted at an upper end of a column 1, the first driving assembly 2 is driven by a first motor 2-1", and a synchronous driving pulley wheel 2-3" is mounted on an output shaft 2-2" of the first driving assembly 2; a synchronous driven pulley wheel 2-4" is mounted at a lower end of the column 1, the slider 3 is sleeved on a middle portion of the column 1 so that the slider 3 is capable of moving along the column 1, and the slider 3 is rotatably hinged to a second connecting rod 6. A synchronous belt 2-5" has a first end and a second end, the first end of the synchronous belt 2-5" connects to the slider 3, the second end of the synchronous belt 2-5" turns around synchronous driving pulley wheel 2-3" and the synchronous driven pulley wheel 2-4" and connects to the slider 3, the synchronous belt 2-5" is in circle and the slider 3 is as a beginning point and a terminal point, performing a circulate motion. An automatic tensioning device, similar to the rope-guide pulley in Embodiment 1, is arranged below the synchronous driven pulley wheel 2-4", and is used for automatically tensioning the synchronous belt 2-5".

When the first motor 2-1" starts to work, the output shaft 2-2" of the first driving assembly 2 is driven to rotate, driving the synchronous driving pulley wheel 2-3" to rotate, so that the synchronous belt 2-5" is driven to transmit, driving the slider 3 to move along the column 1.

When the first motor 2-1" rotates in a forward direction, the synchronous driving pulley wheel 2-3" is driven to rotate in a forward direction, driving the synchronous belt 2-5" to transmit in the forward direction, so that the slider 3 is driven to move upward along the column 1, driving the second connecting rod 6 to move upward, adjusting a pitch angle of the umbrella canopy and unfolding the umbrella.

When the first motor 2-1" rotates in a reverse direction, the synchronous driving pulley wheel 2-3" is driven to rotate in the reverse direction, driving of the synchronous belt 2-5" to transmit in the reverse direction, so that the slider 3 is driven to move downward along the column 1, driving the second connecting rod 6 to move downward, adjusting the pitch angle of the umbrella canopy and folding the umbrella.

Other structure of the third embodiment is similar to Embodiment 1.

The protection scope of the present invention is not limited to each embodiment described in this description. Any changes and replacements made on the basis of the scope of the present invention patent and of the description shall be included in the scope of the present invention patent.

The invention claimed is:

1. An electric umbrella, comprising:

A column having a top;

a first driving assembly;

a slider slidably disposed on the column;

an umbrella frame;

a second driving assembly;

a power source;

a control module; and a traction rope having a first end and a second end;

wherein, the umbrella frame comprises a first connecting rod having a first end and a second end, a second connecting rod, a plurality of long rods, a plurality of short rods, a long rod nest, a short rod nest, a large support rod and a central pipe connecting to either the long rod nest or the short rod nest;

the first end of the first connecting rod rotatably connects to the top of the column and the second end of the first connecting rod rotatably connects to the second connecting rod, the second connecting rod rotatably connects to the long rod nest, the first connecting rod, the slider and the large support rod, respectively;

the first driving assembly is disposed on the column to drive the slider movably along the column so as to adjust an inclination angle of the umbrella frame;

the first driving assembly comprises a first motor, a first driving gear, a first output shaft, a second output shaft, a first rope winding wheel, a second rope winding wheel, a first traction rope segment, a second traction rope segment, and a rope-guide pulley;

the first motor connects to the first rope winding wheel and the second rope winding wheel through the first driving gear, the first rope winding wheel connects to the slider via the first traction rope segment, the second rope winding wheel connects to the slider by the second traction rope segment via the rope-guide pulley, the slider rotatably connects to the second connecting rod;

the second driving assembly is an electric driver which is capable of winding the traction rope for unfolding or folding the umbrella frame, the second driving assembly is disposed on the short rod nest;

the first end of the traction rope connects to the second driving assembly and the second end of the traction rope passes through the central pipe and connects to the long rod nest.

2. The electric umbrella of claim 1, wherein the second driving assembly comprises a second motor having an output and a second driving gear having an input and an output, the output of the second motor connects to the input of the second driving gear, a winding wheel connects to the output of the second driving gears, the traction rope comprises a third traction rope segment, the third traction rope segment is winded on the winding wheel and an end of the third traction rope segment connects to the long rod nest of the umbrella frame.

3. The electric umbrella of claim 1, wherein the rope-guide pulley is mounted on a rope-guide pulley frame, the rope-guide pulley frame is movably mounted on a rope-guide pulley frame fixing plate fastened by a connecting pin having a limiting portion at one end of the connecting pin, the rope-guide pulley frame fixing plate is fixed inside the column, a spring is mounted on the connecting pin which is arranged below the rope-guide pulley frame, and is used for automatically tensioning the traction rope.

4. The electric umbrella of claim 1, wherein the control module comprises a control main board, and a control panel and/or a wireless control module;

the control main board connects to the control panel and/or the wireless control module, and the control main board connects to the first driving assembly and the second driving assembly, so as to control the first driving assembly and the second driving assembly step by step or simultaneously, thereby enabling step-by-step or simultaneous automatic unfolding/folding of the electric umbrella and automatic adjustment of a sun-shading angle of the electric umbrella.

5. The electric umbrella of claim 1, wherein the power source comprises a solar photovoltaic panel, a solar module having two ends and an energy storage battery;

the solar module is arranged between the solar photovoltaic panel and the energy storage battery, the solar module converts solar energy into electric energy to charge the energy storage battery, the energy storage battery may also be charged by the solar energy, or removed to be charged.

6. An electric umbrella, comprising:

a column having a top;

a first driving assembly;

a slider slidably disposed on the column;

an umbrella frame;

a second driving assembly;

a power source;

a control module; and a traction rope having a first end and a second end;

wherein, the umbrella frame comprises a first connecting rod having a first end and a second end, a second connecting rod, a plurality of long rods, a plurality of short rods, a long rod nest, a short rod nest, a large support rod and a central pipe connecting to either the long rod nest or the short rod nest;

the first end of the first connecting rod rotatably connects to the top of the column and the second end of the first connecting rod rotatably connects to the second connecting rod, the second connecting rod rotatably connects to the long rod nest, the first connecting rod, the slider and the large support rod, respectively;

the first driving assembly is disposed on the column to drive the slider movably along the column so as to adjust an inclination angle of the umbrella frame;

the first driving assembly comprises a first motor, a first driving gear, a first output shaft, a second output shaft, a first rope winding wheel, a second rope winding wheel, a first traction rope segment, a second traction rope segment, and a rope-guide pulley;

the first motor connects to the first rope winding wheel and the second rope winding wheel through the first driving gear, the first rope winding wheel connects to the slider via the first traction rope segment, the second rope winding wheel connects to the slider by the second traction rope segment via the rope-guide pulley, the slider rotatably connects to the second connecting rod;

the second driving assembly is an electric driver which is capable of winding the traction rope for unfolding or folding the umbrella frame, the second driving assembly is disposed on the long rod nest;

the first end of the traction rope connects to the second driving assembly and the second end of the traction rope passes through the central pipe and connects to the short rod nest.

* * * * *